United States Patent [19]

Challis

[11] 4,279,325

[45] Jul. 21, 1981

[54] ACOUSTIC TREATMENT FOR FANS

[76] Inventor: Louis A. Challis, 158 Queen St., Woollahra, New South Wales 2025, Australia

[21] Appl. No.: 48,863

[22] Filed: Jun. 15, 1979

Related U.S. Application Data

[62] Division of Ser. No. 695,622, Jun. 14, 1976, Pat. No. 4,174,020.

[30] Foreign Application Priority Data

Jul. 1, 1975 [AU] Australia ..... PC2191
Aug. 13, 1975 [AU] Australia ..... PC2790

[51] Int. Cl.[3] ..... F01N 1/04; E04B 1/82

[52] U.S. Cl. ..... 181/211; 181/222; 181/225; 181/286; 181/292

[58] Field of Search ..... 181/211, 222, 225, 231, 181/284, 286, 288, 292, 276, 295, 296, 208, 209, 206, 213, 214, 224, 250, 252, 291, 293; 415/119, 203-206, 208; 417/362

[56] References Cited

U.S. PATENT DOCUMENTS

| | | | |
|---|---|---|---|
| 3,380,552 | 4/1968 | Segil et al. | 181/292 |
| 3,485,443 | 12/1969 | Earhart | 415/119 |
| 3,980,912 | 9/1976 | Panza | 181/202 |
| 4,001,473 | 1/1977 | Cook | 181/292 |

*Primary Examiner*—Donald A. Griffin
*Assistant Examiner*—Benjamin R. Fuller
*Attorney, Agent, or Firm*—Ladas & Parry

[57] ABSTRACT

Apparatus for attentuating noise emitted from an inlet port to a centrifugal fan comprises a panel member which is mounted in spaced confronting relationship to the inlet port and includes a rigid backing member, a facing mounted in spaced disposition from the rigid backing member, partitions dividing the space between the rigid backing member and the facing into a plurality of cavities, and acoustic infill in the cavities. The facing has a plurality of perforation zones, and is formed in each perforation zone with small perforations whereby the facing is rendered acoustically permeable over a limited area only. One wall of each cavity includes a perforation zone of the facing, whereby the cavities constitute Helmholtz absorption cavities. The facing is adapted to face the inlet port and transmit noise for attenuation in the cavities.

4 Claims, 3 Drawing Figures

ACOUSTIC TREATMENT FOR FANS

This is a divisional of co-pending Application Ser. No. 695,622 filed June 14, 1976, now U.S. Pat. No. 4,174,020 granted Nov. 13, 1979.

The present invention relates to centrifugal fans and more specifically is concerned with noise attenuation and inlet aspects of such fans.

A centrifugal fan comprises a casing within which a scroll usually formed by bending sheet material is mounted, with an impeller rotatably mounted within the scroll. An inlet aperture extending in a direction transverse to the axis of the fan is provided coaxially aligned with the impeller whereby air is drawn into the impeller which on rotation flings the air outwardly against the scroll, this scroll extending from a cut-off of nose portion disposed close to the periphery of the impeller along a curved path extending progressively further away from the impeller for the purpose of discharging the air substantially tangentially through a discharge duct.

It is well known that considerable noise is generated by a centrifugal fan, the noise being of a broad band nature in terms of its frequency and the intensity of the noise or acoustic power is particularly high at the lower end of the frequency range and particularly high in the range 30 Hz to 250 Hz. The noise is propagated principally along two paths namely by emission through the air inlet to the fan and through the air outlet. A principal source noise is that resulting from interaction of air flung outwardly under centrifugal force by the impeller with the scroll of the fan. Additionally there is the so-called "siren effect" of the impeller, this being due to the interaction of each blade of the impeller as it passes the cut-off or nose of the scroll and thus the frequency of this source of noise will depend on fan speed and the number of blades in the impeller.

Centrifugal fans have for many years been used for a wide range of purposes, an important application being in airconditioning systems for buildings. It is becoming increasingly important to provide an effective level of noise attenuation not only in respect of noise transmitted down-stream from the fan and along the air duct but also in respect of noise radiated directly from the inlet of the fan. Furthermore the rapidly spiralling costs of energy have resulted in increasing pressures to avoid deleterious effects in respect of energy consumption when noise attenuation systems are introduced and in general effective noise attenuation has an adverse effect on mechanical efficiency. Therefore there is a need for improvements which would permit efficient operation of centrifugal fans, installation of fans in restricted spaces such as plant rooms for buildings, and effective sound attenuation of centrifugal fans.

The present invention is directed towards these needs and embodiments of the invention may at least in part fulfill at least one of these needs.

According to the present invention there is provided apparatus for attenuating noise generated during operation of a centrifugal fan comprising an acoustically permeable facing onto which the noise will impinge, a rigid backing member, wall means dividing the zone between the backing member and the facing into a plurality of cavities, and the arrangement being such that the noise is attenuated by passage into said cavities.

According to another aspect of the invention there is provided an inlet guide member for a centrifugal fan having an axial inlet comprising a rigid backing, an acoustically permeable facing mounted on the backing with a cavity therebetween for disposition in spaced confronting relationship with the axial inlet and having a shape such that the air flow is guided into the inlet from around the guide member, and acoustically absorbent infill located in the cavity.

The apparatus or guide member as described above advantageously contains Helmholtz noise absorption cavities located between the facing and the rigid backing member, sound absorbing material such as fibreglass or mineral wool or plastic foam material being located within each cavity. Advantageously if fibreglass or mineral wool is used, then the wool is wrapped in a cloth or scrim to provide resistance to fibre erosion.

A Helmholtz cavity may be defined as a cavity having a restricted entrance whereby the volume of the cavity is greater than or equal to the effective face dimensions from an acoustic point of view of the aperture coupling the cavity to the region beyond and from which the noise passes.

Important and preferred embodiments of the invention are advantageously provided with the Helmholtz cavities tuned so as to have respective different centres to their absorption bands whereby a wide range of frequencies are absorbed by the apparatus.

The tuning of the cavities is preferably such that the envelope of the acoustic power absorption curves of the cavities generally correspond to the acoustic power curve of the centrifugal fan, a relatively high degree of absorption occuring in the low frequency range of 30 Hz to 250 Hz.

In addition to Helmholtz cavities, additional absorption can be provided by other sound attenuating means such as conventional absorbent materials which can be particularly effective on higher frequency noise.

The present invention may be applied to dealing with the problems of either or both of the main noise paths namely along the outlet path or emission from the inlet to the centrifugal fan. Preferably the apparatus is applied by its inclusion in the centrifugal fan itself and also as an auxillary panel member located in spaced confronting relationship to the inlet.

When applied to the centrifugal fan itself, the scroll of the fan provides the facing through which the noise passes, the cavities being located between the facing and the backing member which forms a casing for the fan. The casing preferably is a rigid rectangular box structure of airtight form and of sufficient rigidity to permit effective noise attenuation.

Hitherto it has been proposed to provide a noise attenuation device in the outlet duct extending downstream from the fan but this can have a serious disadvantageous effect on the system efficiency and furthermore economic effective attenuation at lower frequencies has not occured. Furthermore systems have had to be designed with a relatively long duct section downstream from the fan before any take-off points and this itself has contributed to high initial costs as well as loss of space which would otherwise be available for other purposes. In order to provide reasonable noise attenuation at lower frequencies such devices located in the duct downstream of the fan have been both expensive and physically very large and thus obviously undesirable in view of these features.

By contrast the present invention adopts a treatment for attenuating the noise at a location immediately adjacent its source and it is believed that attractive operational efficiency of the fan can be achieved when acoustic treatment embodying the present invention is utilized when compared with the same fan without the treatment. Furthermore use of the present invention permits compact installations to be provided and economies in space and the cost of surrounding structure such as plant room walls can be made particularly where the more efficient forms of the invention are adopted.

It must be accepted that by perforating the scroll of the fan and providing acoustically absorbent material behind the scroll one may provide limited noise attenuation and such arrangements are disclosed in U.S. Pat. Nos. 3,312,389, 3,174,682 and 2,160,666 but the adoption of such perforated scrolls must result in a penalty in terms of extra power required for operation of the fan. Preferred embodiments of the invention, by contrast can include efficient scroll designs. One form of scroll design comprises the use of relatively small perforated areas of the scroll for acoustically coupling each cavity with the impeller region of the fan.

One important form of this feature is locating the perforations in a strip like area extending across the scroll and substantially parallel to the axis of the fan, whereby relatively large unperforated zones occur in the scroll between the perforated strips. The walls dividing the zone between the scroll and the casing of the fan can then be secured to the scroll at the unperforated regions and thus provide rigidity and strength to the scroll. This configuration can be utilised with a very small percentage of the area of the scroll perforated and thus a major deleterious effect on the power required to operate the fan can be avoided.

An alternative form of scroll design, is to form the facing from a rigid sheet of material having at least one aperture for each of the cavities and covering each aperture with a flexible strong film of a suitable material whereby acoustic coupling occurs between the impeller region of the fan and the cavity as a result of vibration and flexing of the film but there is no aerodynamic coupling. This can provide for efficient mechanical design of the fan and furthermore in certain applications such as hospital situations bacteria control in the air is facilitated since transfer of dust and bacteria laden air from the casing of the fan can be prevented.

In other applications where a dust laden atmosphere is being pumped by the fan the casing of the fan may be provided with dust extraction means whereby the dust tends to be flung by the centrifugal force through perforations in the scroll and into the casing, from which the dust is extracted possibly by a cyclone system.

As an alternative to or as an addition to the features described above for use in the casing of the centrifugal fan, the invention may advantageously permit treatment of the fan adjacent its axial inlet port. A panel member is provided for location in spaced confronting relationship with the axial port, the panel member having a facing which is shaped to deflect the air smoothly into the inlet to the fan from the annular zone around the panel member.

For the purpose of attenuating noise emitted through the air inlet port, the panel member is provided with an acoustically permeable facing which is spaced from a rigid backing on which it is mounted, the zone between the backing and the facing having means for absorbing or attenuating the noise. These means may comprise known or conventional acoustically absorbent infill material and may include Helmholtz cavities.

In the past it has generally been considered as a reasonable practical guide that the distance from the inlet aperture of a centrifugal fan must be a distance roughly equal to the diameter of the impeller of the fan. This has placed significant restraints on the design of equipment having regard to available space for installations but embodiments of the present invention can include a panel member as described above located at a small distance from the inlet aperture to the fan. Not only can very acceptable power consumptions of the fan be provided for with the present invention but also the power consumption levels can be provided at the same time as effective noise attenuation. Furthermore the overall dimensions of the centrifugal fan can be very small and the whole apparatus can be located if necessary with the rear face of the panel member against a wall of the building. Thus architects can provide relatively small plant rooms permitting more space available for other purposes including letting to tenants. Furthermore the acoustic treatment of the fan can permit cheaper and less substantial structures than would otherwise be possible and furthermore take-off points for installations to be serviced by the fan can generally be made at much closer points than would be possible without the use of the proposals disclosed herein.

Advantageously a panel member can be positioned spaced from the fan with means for reducing separation of the inlet port from the panel for the purpose of reducing the volume of air flow handled by the fan. In at least preferred embodiments of the invention reducing the spacing can also reduce the noise of the fan, whereas in conventional centrifugal fans, there is a great increase in noise as the inlet aperture is throttled. Conventionally, fans have a multiplicity of rotatable plates or vanes provided for closing the inlet aperture to the desired extent. As the plates are closed there is a great increase in noise.

Another feature, which can be used as an alternative, is to provide in the cavity for the fan casing and/or the panel member a honeycomb of Helmholtz absorbers, the cells of the honeycomb having different centres to their absorption frequency bands. A single aperture couples each cell to the source of noise and broad band absorption may be provided without acoustic infill. The varying distance between the curved scroll and rectangularly panelled casing can be used to provide different path lengths and thus different absorption bands for the cells.

One embodiment of the invention will now be described, by way of reference to the accompanying drawings on which:

Figure 1:
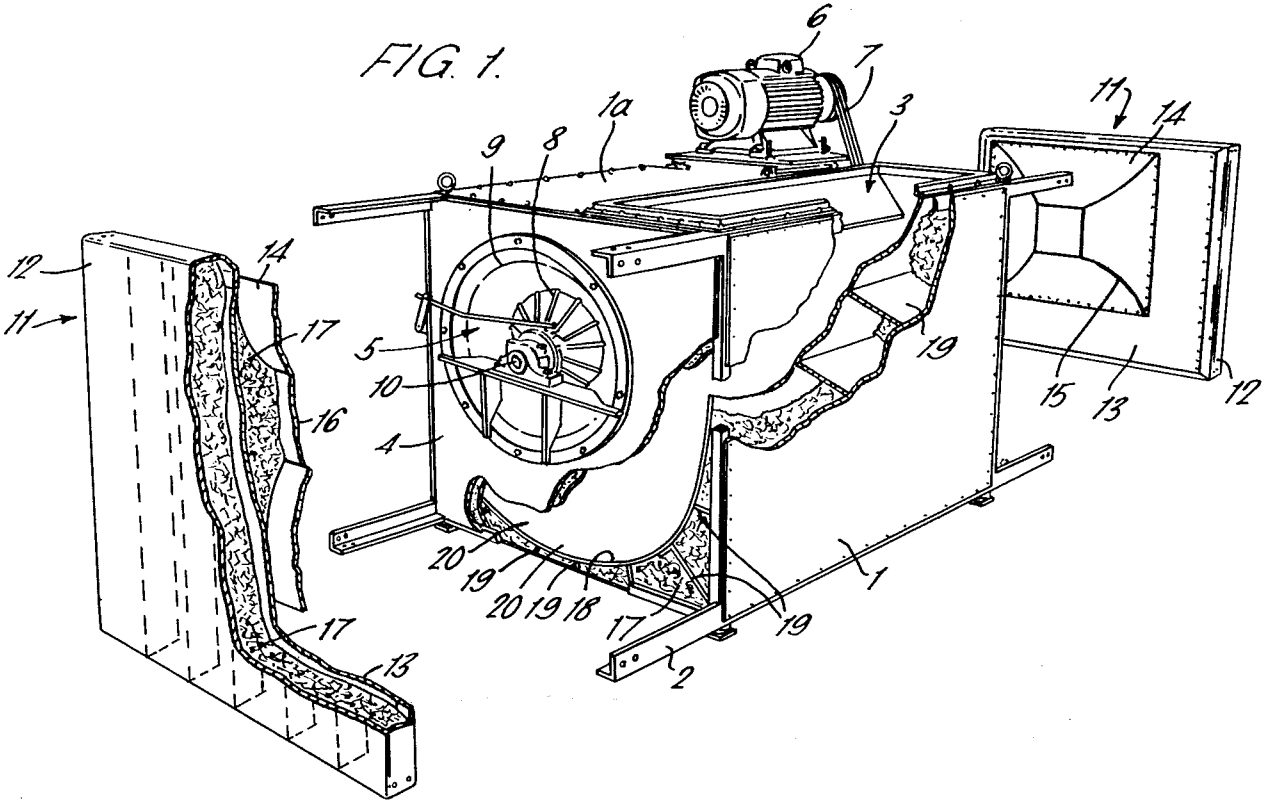
FIG. 1 is a perspective partially broken-away view of a double ended centrifugal fan embodying the present invention.

The centrifugal fan comprises an outer casing 1 of rectangular panels fixed to a rigid framework 2, an outlet port 3 being located in the top panel 1*a* and each end panel 4 having a circular inlet port 5. An electric motor 6 is mounted on the top of the casing and by means of belts 7 drives the impeller 8, an inlet cone 9 guiding the air from the inlet port to the impeller.

FIG. 1 shows the arrangement at one end only, a similar arrangement being provided at the other end, the illustrated fan being a double width, double inlet fan. The impeller 8 is mounted on a shaft which extends through the fan and is mounted in bearings 10 at each end.

For the purpose of guiding airflow into the inlet ports a panel member 11 is provided at each end. In this embodiment each panel member is to be secured to the framework 2 at a fixed position, the spacing between each panel member and adjacent end plate 4 being approximately 30% of the diameter of the impeller.

Each panel member 11 has a rigid steel backing 12 and an acoustically permeable facing 13 which in this embodiment is formed from closely perforated metal sheet. The panel includes a guide member 14 also formed from perforated metal sheets, each guide member being formed from four curved sheets which are concave and join one another along welded ridges or hips 15, a square centre panel 16 providing a flat nose. The hips 15 act to reduce substantially the whirling effect which otherwise would occur and this reduction in the whirling effect can be substantially advantageous from a power point of view.

The panel member 11 which is broken away shows the interior structure as comprising fibreglass or mineral infill 17 between the permeable sheet 13 and the backing 12 and between the guide member 14 and the permeable sheet 13. In this embodiment the panel member is not shown as having a plurality of Helmholtz cavities but partition walls (shown in broken lines) are included to provide such cavities.

Figure 2:
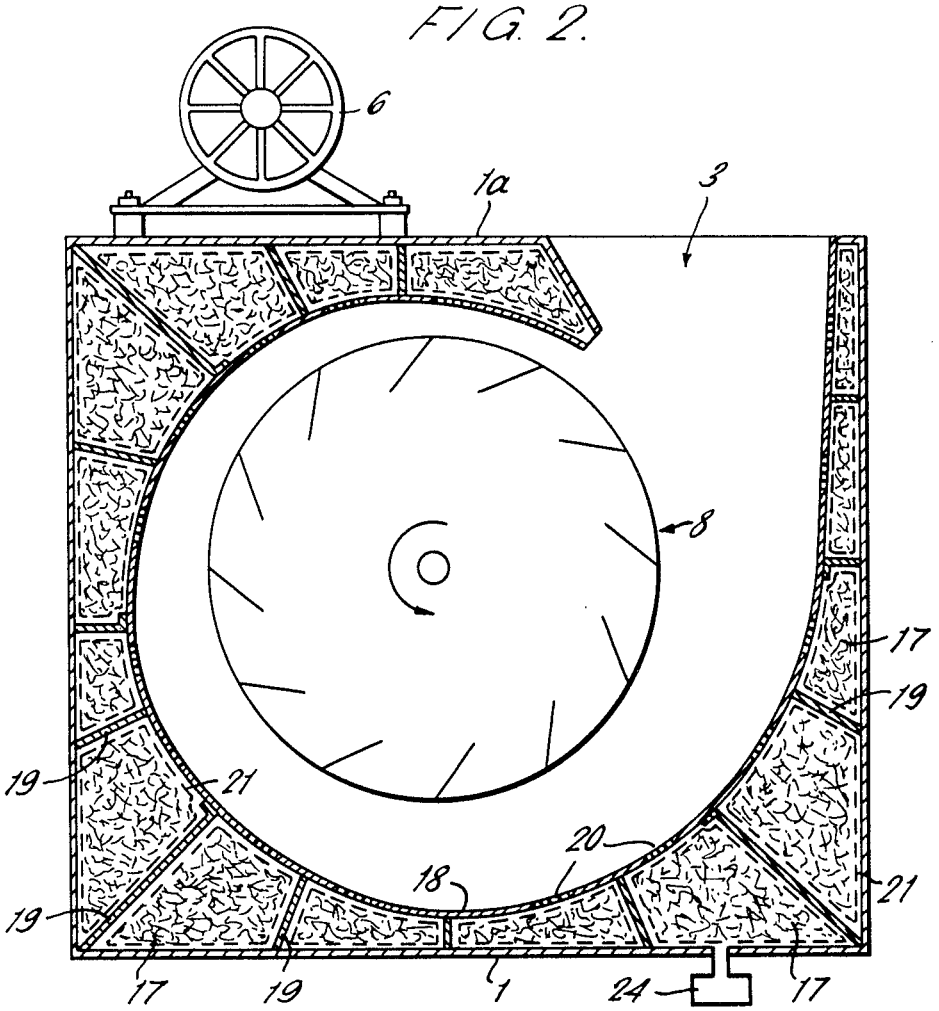
FIG. 2 is schematic cross-section of the fan.

Acoustic absorption is also provided in the fan between the fan scroll 18 and the outer casing 1, acoustic infill 17 also being provided. FIGS. 1 and 2 show partition walls 19 extending between the casing and the scroll to divide the casing into a plurality of Helmholtz absorption cavities having different respective resonance frequencies. A Helmholtz absorption cavity (an acoustic cavity contained by rigid walls and connected to the region beyond by a small acoustically permeable opening which couples the cavity to the region beyond and from which the noise passes) has its resonant frequency determined by the combination of physical parameters comprising the effective face area of the acoustically permeable opening, the thickness of the throat defining the acoustically permeable opening and the volume of the cavity behind the facing. The acoustic infill provides a broadened acoustic absorption band centered on the resonant frequency. The scroll is formed with perforations which are arranged in strips or bands 20 extending substantially across the scroll in a direction parallel to the axis of the fan. The cavities are thus connected acoustically to the interior of the scroll. This can permit effective acoustic coupling without extensive perforation and thus without excessive aerodynamic drag. Typically the area of perforation may be as small as 10% of the scroll area.

Comparison data will now be given of one embodiment of the invention, the data comparing a standard double width double inlet air foil fan fitted with inlet vane control and having a rotor diameter of 26½", an inlet diameter of 27" and an outlet of 23 and one-eighth inch by 39½". The fan was operated firstly without any acoustic treatment and secondly with acoustic treatment of the type shown in FIG. 1, the fan operating to produce 16,500 cubic feet per minute at 1500 r.p.m. and 14.1 b.h.p.

| Octave Band Centre Frequencies<br>Octave Band No. | 63<br>1 | 125<br>2 | 250<br>3 | 500<br>4 | 1000<br>5 | 2000<br>6 | 4000<br>7 | 8000<br>8 |
|---|---|---|---|---|---|---|---|---|
| Inlet Vane control fully open | | | | | | | | |
| Standard fan inlet or discharge noise dB re $10^{-12}$ watts | 99 | 92 | 96 | 87 | 84 | 81 | 79 | 73 |
| Acoustic fan at inlet noise dB re $10^{-12}$ watts | 80 | 84 | 86 | 83 | 84 | 80 | 80 | 67 |
| Noise reduction of acoustic fan relative to standard dB | −19 | −8 | −10 | −4 | 0 | −1 | −1 | −6 |
| Noise on acoustic fan at discharge dB re $10^{-12}$ watts | 90 | 87 | 88 | 86 | 87 | 80 | 77 | 74 |
| Reduction of acoustic fan noise at discharge relative to standard fan dB | −9 | −5 | −8 | −1 | +3 | −1 | −2 | +1 |
| Inlet vane control of fans 30° closed | | | | | | | | |
| Standard fan inlet noise dB re $10^{-12}$ watts | 107 | 99 | 102 | 92 | 89 | 86 | 84 | 78 |
| Acoustic fan measured inlet noise dB re $10^{-12}$ watts | 82 | 86 | 87 | 83 | 85 | 79 | 74 | 66 |
| Noise reduction of acoustic fan over standard fan dB | −25 | −13 | −15 | −9 | −4 | −7 | −10 | −12 |
| Standard fan noise at discharge dB re $10^{-12}$ watts | 107 | 99 | 102 | 92 | 89 | 86 | 84 | 78 |
| Acoustic fan measured noise at discharge dB re $10^{-12}$ watts | 89 | 86 | 85 | 82 | 83 | 76 | 70 | 66 |
| Reduction of acoustic fan relative to conventional fan at discharge dB | −18 | −13 | −17 | −10 | −6 | −10 | −14 | −12 |

From the above data it will be apparent that particularly up to 250 Hz a substantial noise reduction is achieved at both the inlet and discharge, and an even greater noise reduction is obtained where the inlet vane control is 30° closed.

FIG. 2 shows in detail a preferred embodiment in which the acoustic infill 17 in each cavity is disposed in a cloth or scrim cover 21 to counter fibre erosion.

Furthermore, in order to remove dust from the cavities, a dust extractor may be provided, one dust extractor being shown schematically at 24 for illustrative purposes.

Figure 3:
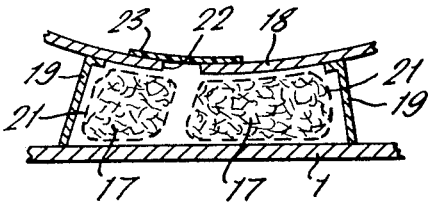
FIG. 3 illustrates in cross-section a modification of the fan.

A further feature which may be used in embodiments of the invention is shown in FIG. 3 which illustrates in a cross-section a modification to the scroll 18. In place of perforations, the scroll is formed with a small slot 22 for each cavity and a sheet of plastic film 23 of tough and durable form is secured over the slot with adhesive. Each slot 22 extends parallel to the axis of the fan and substantially across the full width of the scroll. Thus, acoustic permeability without deleterious aerodynamic effects can be provided. The plastic film 23, being thin and flexible, has high acoustic permeability with low transmission loss and, being secured with adhesive, forms a substantially air-tight seal reducing surface drag frictional effects.

I claim:

1. Apparatus for attenuating noise emitted from an inlet port to a centrifugal fan, and comprising a panel member adapted to be mounted in spaced confronting relationship to said inlet port, said panel member including (a) a rigid backing member, (b) a perforated, acoustically permeable facing mounted in spaced disposition from said rigid backing member and adapted to face said inlet port, (c) wall means dividing the space between said rigid backing member and said facing into a plurality of Helmholtz absorption cavities, said facing providing a small area of perforation for each of said cavities for transmitting noise into said cavities, at least a substantial portion of said cavities being dimensioned to have resonant frequencies in the range of about 30 Hz to 250 Hz, and (d) acoustic infill in the absorption cavities between said rigid backing member and said facing, whereby said apparatus has a high degree of attenuation in the range of about 30 Hz to 250 Hz.

2. Apparatus as claimed in claim 1, wherein said facing includes a nose-like portion extending away from said backing member for deflecting air flow into said inlet port.

3. Apparatus as claimed in claim 2, wherein said nose-like portion comprises concave side walls connected to one another along adjacent edges.

4. A centrifugal fan comprising a scroll, an impeller mounted to rotate within the scroll, an inlet port at one axial end of the impeller and apparatus for attenuating noise emitted from the inlet port, said apparatus comprising a panel member mounted in spaced confronting relationship to said inlet port and including:

(a) a rigid backing member, (b) a perforated, acoustically permeable facing mounted in spaced disposition from said rigid backing member and adapted to face said inlet port, (c) wall means dividing the space between said rigid backing member and said facing into a plurality of Helmholtz absorption cavities, said facing providing a small area of perforation for each of said cavities for transmitting noise into said cavities, at least a substantial portion of said cavities being dimensioned to have resonant frequencies in the range of about 30 Hz to 250 Hz, and (d) acoustic infill in the absorption cavities between said rigid backing member and said facing, whereby said apparatus has a high degree of attenuation in the range of about 30 Hz to 250 Hz.

* * * * *